United States Patent [19]

Kroll et al.

[11] 4,359,189

[45] Nov. 16, 1982

[54] AUTOMATIC ELECTROSTATIC CENTRIFUGAL ATOMIZER SYSTEM

[75] Inventors: Arthur T. Kroll, Oak Park, Ill.; Richard M. Sherman, Birmingham, Mich.

[73] Assignee: Gralo Inc., Minneapolis, Minn.

[21] Appl. No.: 246,419

[22] Filed: Mar. 23, 1981

[51] Int. Cl.[3] ..... B05B 1/28

[52] U.S. Cl. ..... 239/121

[58] Field of Search ..... 239/104, 106, 120–122

[56] References Cited

U.S. PATENT DOCUMENTS 426,512 4/1890 Parker ..... 239/121

3,155,539 11/1964 Juvinall ..... 239/122 X

*Primary Examiner*—Joseph E. Valenza

*Assistant Examiner*—Paul A. Sobel

[57] ABSTRACT

Apparatus is disclosed having a centrifugal electrostatic atomizer pivotally mounted at the end of an extended arm, having variable atomization application positions, waste receptacle collector positioned beneath said atomizer, and pivotal mechanism for bringing the atomizer head to a position inside the receptacle for purging and solvent cleaning.

9 Claims, 3 Drawing Figures

AUTOMATIC ELECTROSTATIC CENTRIFUGAL ATOMIZER SYSTEM

BACKGROUND OF THE INVENTION

This invention relates to a system and apparatus for the electrostatic atomization of liquids, particularly paint. The invention is particularly useful in assembly or conveyor line applications of paint, wherein articles move along such a line past stations designated for the application of paints in single or multiple colors.

In the assembly line manufacture of products, particularly products having large surface areas requiring paint, there has long been a need for automated systems for application of such paint, or other coating materials, in a consistent, high-quality manner with minimum loss of the paint or coating material. In older assembly line operations such products were typically painted using manually operated air spray paint guns in booths especially designed for the passage of the product along an assembly line, and for the convenience of personnel to paint the products as they pass through the booth. Since a large amount of paint applied in this manner is lost through overspray, such booths typically have a controlled air flow to direct overspray into residue collectors which are frequently or continuously cleaned to remove the residue from the booth. The oversprayed paint is considered a waste byproduct of the painting operation, and the residue collection facilities add energy and other costs which contribute to the overall plant operating expense.

More recent assembly line manufacturing techniques have utilized so-called "automatic" spray guns, either fixedly mounted or mounted on vertically reciprocable arms, which can be actuated at the precise moment the product passes in front of the paint station. Such systems are usually used in conjunction with manually operated spray guns to enable the complete coating of all surfaces, including surfaces of high curvature and unusual geometry which automatic spray equipment cannot cover. Automatic paint spray systems typically also suffer from a high percentage of loss of the coating material from overspray and other factors.

Automobile assembly plants typically use such systems for the painting of the body shell, fenders, hood and trunk lids, and other components of considerable surface area. Automobile assembly plants do not, for a variety of reasons, construct vehicles with any degree of color conformity, but rather utilize a system wherein an almost random sequence of colors may be applied to any given sequence of automobile bodies passing along the assembly line. This requirement imposes upon automobile assembly plants the additional requirement that automatic and manual paint spray equipment be equipped to apply any of a preselected number of colors in any order, and to change from one color to another in the brief period of time between the passing of one product and the arrival of the next product on the moving assembly line. Color changers have been adapted to accomplish this function, and today automobiles roll off the assembly line in any variety of sequential color combinations.

Electrostatic paint spraying has long been recognized as providing an improvement in coating efficiency over conventional spray painting techniques. The use of electrostatic paint spray guns causes an electrostatic field to develop between the spray gun and the article to be painted, the field both assists in the atomization of the paint and also develops attractive forces between the spray gun and the article to be painted in such a manner so as to attract paint particles to the surface to be coated. Electrostatic paint spraying techniques yield a considerably higher efficiency of coating over conventional air spray or conventional airless spray techniques. Applications of up to 95 percent of the paint material emitted from an electrostatic spray gun are readily applied to the product, resulting in very low paint losses due to overspray and other factors.

Centrifugal atomization of paint, accomplished by applying an atomizing paint through the use of a rotating disc, usually in combination with electrostatic forces, enables improvements in both coating quality and in coating deposition efficiency. However, until fairly recently, such techniques have not been utilized in the automobile industry, both for the reason that a special equipment had not been developed for this purpose, and also for the reason that centrifugal atomizers generally tended to provide a poorer quality of coating. However, recent improvements in centrifugal atomizer technology have improved coating quality, and new inventions, such as the present invention, are being developed to enable the adaptation of centrifugal atomizers to assembly line paint spraying operations involving large products such as automobiles.

SUMMARY OF THE INVENTION

The present invention includes a centrifugal atomizer attached to a bracket which is pivotally mounted at the end of an extended arm. The arm may be fixedly attached to a support member, or may be movably attached in either the horizontal or vertical directions. A collection receptacle is suspended below the arm, and is positioned to accept at least a partial entry of the centrifugal atomizer into the receptacle whenever the atomizer-connected bracket is pivoted downwardly. The collection receptacle is used to collect paint and solvent residue which are normally purged from the atomizer system after completing a painting operation or between successive painting operations utilizing different colors of paint.

It is a primary object of this invention to provide a centrifugal atomizer which is adjustable to a plurality of positions, including a position for collecting paint residue.

It is another object of the present invention to provide a centrifugal atomizer residue receptacle which captures and confines all of the paint residue from the atomizer device.

It is another object of the present invention to provide a centrifugal atomizer system which may be utilized for the application of a plurality of paint colors, with automatic cleaning and residue collection during paint color changeover.

These and other objects will become apparent from the appended specification, and with reference to the drawings which form a part of the specification.

DESCRIPTION OF THE PREFERRED EMBODIMENT

Figure 1:
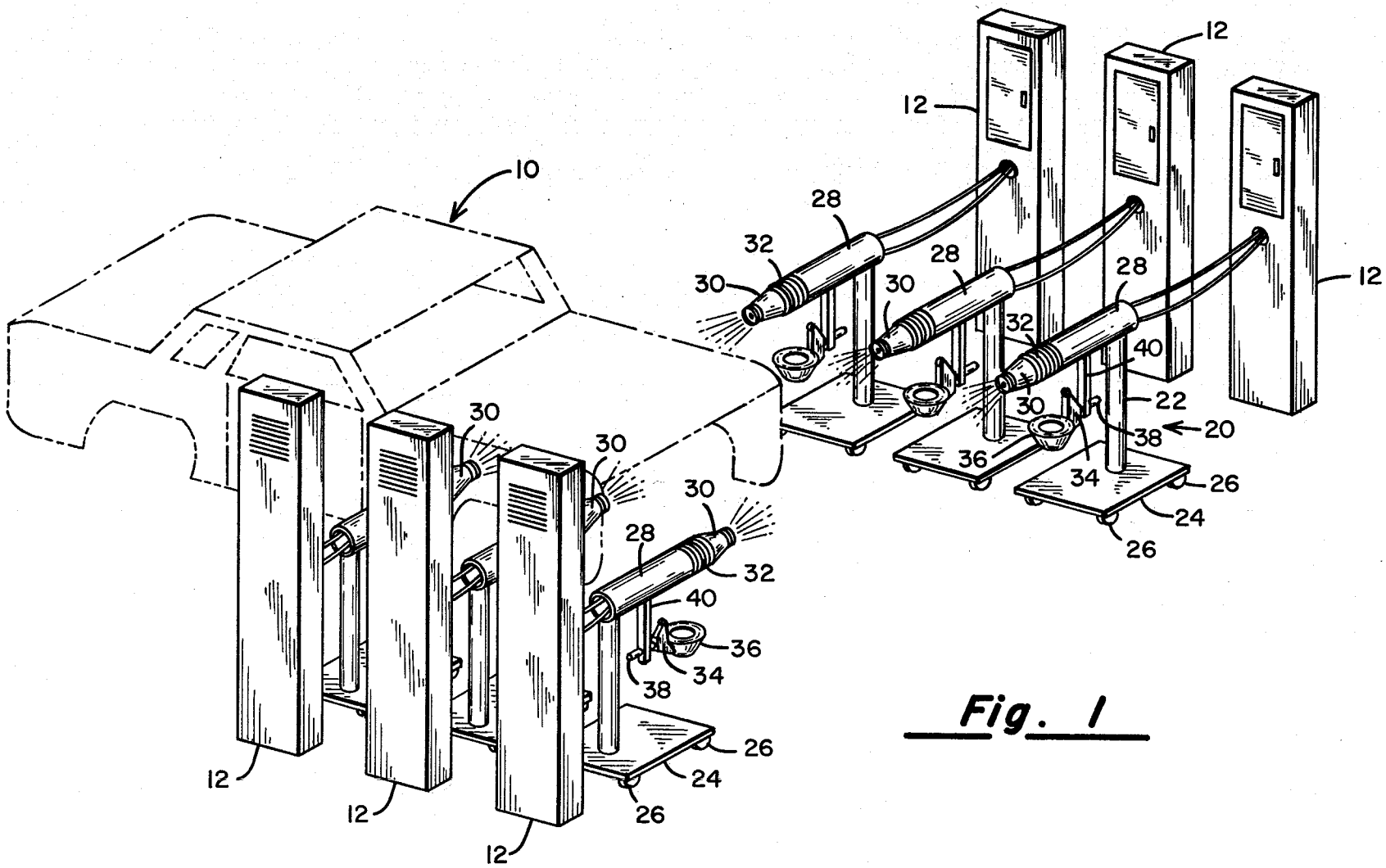
FIG. 1 shows the invention utilized in combination in an assembly line spraying operation.

Referring first to FIG. 1, there is shown a typical assembly line construction utilizing the present invention. A vehicle 10 is moved along a conveyor to pass inbetween parallel rows of painting devices. The conveyor is synchronized to the painting devices to selectively actuate the devices as the vehicle 10 passes in proximity to the respective spray heads of the devices. The construction of each of the painting devices is identical to the others, and painting device 20 will be described as an example of this construction.

Painting device 20 includes a vertical support member 22 affixed to a base 24. Base 24 may have a plurality of wheels 26 for providing horizontal movement of the device, or alternatively base 24 may be rigidly mounted to the flow structure. In the event base 24 is horizontally movable, it may be controlled by programmable actuators (not shown) to regulate the horizontal position and rate of movement.

The hollow support arm 28 is attached to vertical support member 22. An atomizer 30 is pivotally mounted at one end of support arm 28, and a flexible cover 32 extends between atomizer 30 and the end of support arm 28. According to the teachings of the present invention, atomizer 30 is pivotal in a vertical plane over a predetermined angle by apparatus to be hereinafter described.

A collection receptacle 36 is suspended beneath support arm 28 by means of bracket 40. Bracket 40 is fixedly attached to the underside of support arm 28, and a positionable rod 38 is secured near its lower end. Rod 38 is connected to a receptacle holder 34 which in turn supports receptacle 36. A plurality of hoses are connected between painting device 20 and a distribution box 12. These hoses are used to transfer paint, solvent, and air into painting device 20 for various uses to be described hereinafter.

Figures 2, 3:
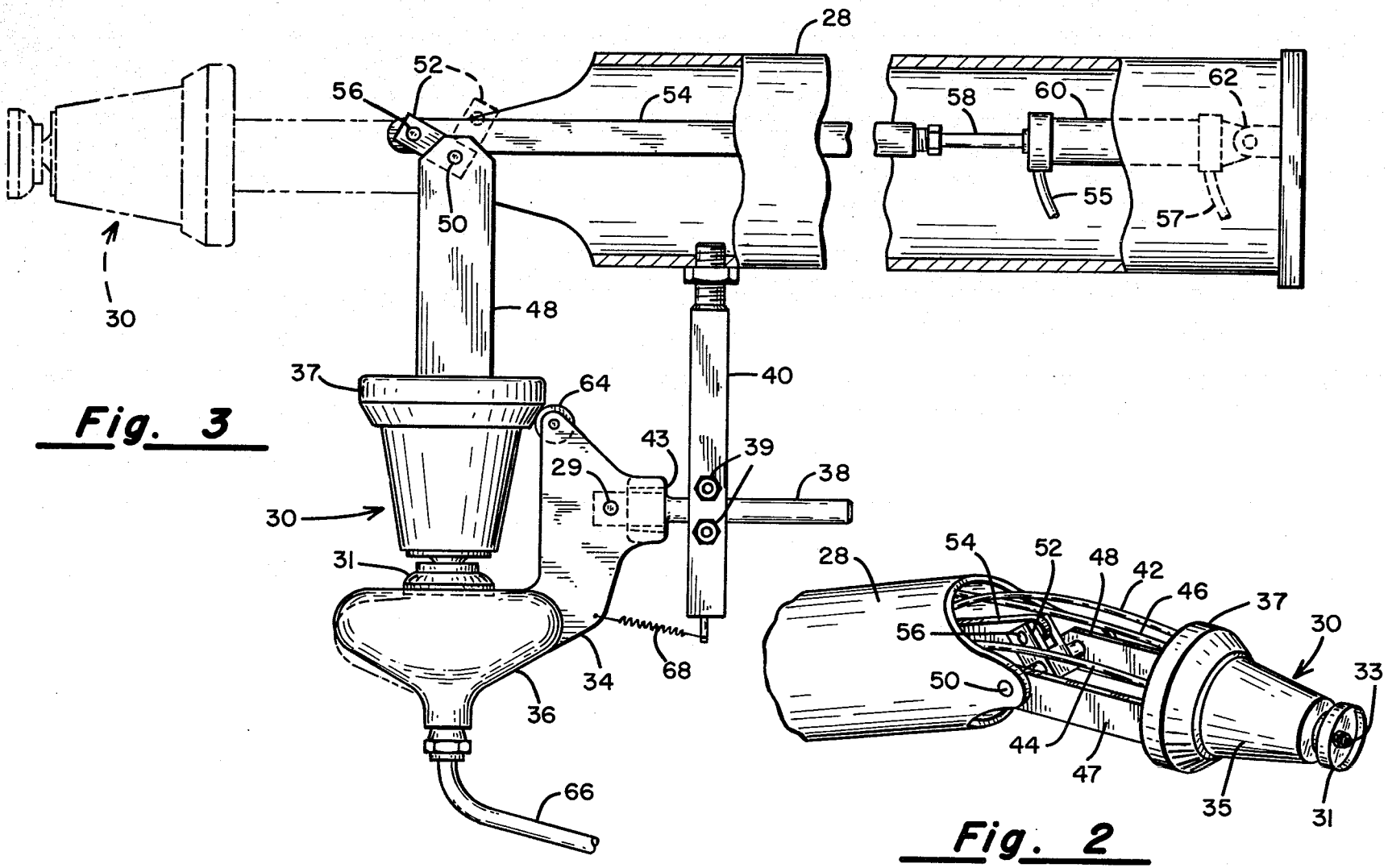
FIG. 2 shows the atomizer head of the present invention.
FIG. 3 shows the invention in side view in two positions.

Referring next to FIG. 2, an isometric view of a portion of support arm 28 and atomizer 30 is shown, with cover 32 removed for simplicity. Atomizer 30 includes a disk 31 which is attached to the shaft of an air motor by means of fastener 33, which air motor is contained with housing 35. A base plate 37 is equipped with fittings for connection to an air hose 42, a paint hose 44, and a solvent hose 46. Base plate 37 is securely attached to bracket arms 47, 48, which extend rearwardly and are fixedly attached to shaft 50. A U-bracket 51 is also fixedly attached to shaft 50, and a lever 54 is pivotally attached to U-bracket 52 at pin 56. Lever 54 extends rearwardly into the hollow interior of support arm 28. Hoses 42, 44, 46 extend rearwardly through the hollow interior of support arm 28.

FIG. 3 shows the invention in elevation view, and in partial cross section and cutaway. Two positions of atomizer 30 are shown, the solid outline illustrating the atomizer 30 position for cleaning and discharging paint residue, and the dotted outline position showing atomizer 30 in a typical paint spraying position. Cover 32 has been deleted from the drawing for purposes of clarity. Lever 54 extends rearwardly from U-bracket 52 to a connection with an extensible and retractable rod 58 which forms a part of an air cylinder 60. Air cylinder 60 is attached at its other end to support arm 28 at pivot 62. Air lines 55 and 57 are connected to air cylinder 60, and pass through the rear of support arm 28 to an operable connection in distribution box 12.

Bracket 40 is rigidly attached to support arm 28 and extends downwardly therefrom. Rod 38 is clamped against bracket 40 by a U-bolt and fasteners 39. Rod 38 may be adjusted axially by loosening fasteners 39 and repositioning rod 38. Receptacle holder 34 is pivotally attached to rod 38 at pin 29. The opening 43 into receptacle holder 34 for accepting the end of rod 38 is slightly conical in size. This conical opening permits a small degree of pivotal motion of receptacle holder 34 about rod 38 because of the pivotal connection at pin 29. The degree of pivotal motion is shown in FIG. 3, wherein receptacle 36 is shown in a first position in solid outline and in a second position in dotted outline. Receptacle holder 34 is attached to receptacle 36 in supporting relationship. A drain hose 66 may be connected to the bottom of receptacle 36 for draining accumulations of liquid residue therefrom. A spring 68 is connected between receptacle holder 34 and bracket 40, to tend to hold receptacle 36 in its lower or dotted outline position. When atomizer 30 is brought into contact with roller 64 it pivotally moves receptacle holder 34 and receptacle 36 into the position shown in solid outline in FIG. 3. In this position, the front face of atomizer disk 31 is recessed inside of receptacle 36. In operation, paint and air are supplied to atomizer 30 in a manner well-known in the art, and the spinning of atomizer disk 31 causes the paint to become centrifugally atomized and applied to particles in proximity to atomizer 30. The preferred operational position for atomizer 30 is shown in dotted outline in FIG. 3, wherein bracket arm 48 is fully or nearly fully extended. After the painting operation is completed, or when the color of paint is to be changed, air cylinder 60 is actuated to extend cylinder arm 58 and thereby move lever 54 in extension outwardly from support arm 28. This causes bracket arm 48 to pivot downwardly, and brings base plate 37 into contact with roller 64. The force of base plate 37 acting against roller 64 causes receptacle holder 34 to pivot about pin 29, and raises receptacle 36 relative to disk 31, to the point wherein disk 31 is at least partially recessed inside of receptacle 36. In this position, the paint residue may be purged from the atomizer, a solvent cleaning solution may be flushed therethrough, and a new paint color component may be introduced into the atomizer fluid coupling circuits. All of the material centrifugally removed from atomizer disk 31 while it is partially inserted into receptacle 30 is accumulated within receptacle 30. This material may be drained or pumped from within receptacle 36 by means of drain hose 66. It should be noted that, during the typical transition from one painting operation to the next, and while atomizer 30 is pivotally moved from its painting position to its residue or cleaning position, the atomizer disk 31 is shut off so as to cease further atomization during the transitional moving phase. The atomizer disk is then restarted after it is inserted into the opening of receptacle 36.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An apparatus for operating a centrifugal paint atomizer in a paint application position and in a cleaning position, comprising (a) an arm attached to said centrifugal atomizer, said arm having a pivotable attachment at its distal end;
(b) actuator means for moving said arm and said atomizer about said pivotable attachment; and
(c) a collector positioned below said pivotable attachment, and having an opening to receive said atomizer upon actuation of said actuator means.

2. The apparatus of claim 1, wherein said collector further comprises a pivotable mounting bracket for pivoting said collector in a vertical plane over a limited range of movement, and means for engaging said atomizer against said mounting bracket to cause limited range of movement of said collector.

3. The apparatus of claim 2, wherein said collector mounting bracket further comprises a roller positioned for engagement against said atomizer in at least one of said atomizer positions.

4. The apparatus of claim 3, wherein said actuator means further comprises an air cylinder having an extensible and retractable rod coupled to said pivotable attachment.

5. The apparatus of claim 4, further comprising a hollow support arm housing said air cylinder, and having a forward pivot point supporting said atomizer arm pivotable attachment.

6. The apparatus of claim 5, further comprising means for moving said support arm, said atomizer and said collector in unison.

7. A centrifugal paint spray apparatus and positioner, comprising
(a) a base;
(b) a vertical support member attached to said base;
(c) a support arm attached to said vertical support member, said support arm having a hollow opening therethrough, and having a distal end with a pivotable shaft mounted thereon;
(d) a bracket attached to said shaft at one end and attached to said centrifugal paint spray apparatus at another end;
(e) an actuator connected to said bracket and housed in said hollow support arm;
(f) a collection receptacle suspended from said support arm and positioned beneath said support arm shaft; and
(g) means for moving said actuator to cause said paint spray apparatus to pivot about said support arm shaft to a position wherein said paint spray apparatus is at least partially inserted into said collection receptacle.

8. The apparatus of claim 7, further comprising a receptacle holder coupled to said collection receptacle, and a bar connected to said support arm, said receptacle holder being pivotally coupled to said support bar.

9. The apparatus of claim 8, wherein said receptacle holder further comprises means for engaging against said paint spray apparatus over the limited range of paint spray apparatus positions wherein receptacle holder pivotal motion occurs.

* * * * *